US007101060B2

(12) United States Patent
Oppenheimer et al.

(10) Patent No.: US 7,101,060 B2
(45) Date of Patent: Sep. 5, 2006

(54) SUBMERSIBLE LIGHTING

(75) Inventors: Richard Oppenheimer, Chelsea Heights (AU); Mark David Pryor, Highett (AU)

(73) Assignee: Hella Australia PTY, Ltd., Mentone (AU)

( * ) Notice: Subject to any disclaimer, the term of this patent is extended or adjusted under 35 U.S.C. 154(b) by 117 days.

(21) Appl. No.: 10/488,611

(22) PCT Filed: Sep. 5, 2002

(86) PCT No.: PCT/AU02/01222

§ 371 (c)(1),
(2), (4) Date: Aug. 12, 2004

(87) PCT Pub. No.: WO03/021145

PCT Pub. Date: Mar. 13, 2003

(65) Prior Publication Data

US 2005/0024876 A1 Feb. 3, 2005

(30) Foreign Application Priority Data

Sep. 5, 2001 (AU) ..... PR7514

(51) Int. Cl.
*F02V 29/00* (2006.01)

(52) U.S. Cl. ..... 362/267; 362/101; 362/310

(58) Field of Classification Search ..... 362/267, 362/158, 101, 96, 310, 329
See application file for complete search history.

(56) References Cited

U.S. PATENT DOCUMENTS

| | | | | |
|---|---|---|---|---|
| 3,106,349 | A | 10/1963 | Bloodgood | |
| 4,281,367 | A | 7/1981 | Moore et al. | |
| 4,506,314 | A * | 3/1985 | Moore | 362/267 |
| 4,617,617 | A | 10/1986 | Cunningham et al. | |
| 5,128,845 | A * | 7/1992 | Hoffmeier | 362/187 |
| 5,980,065 | A * | 11/1999 | Wooderson | 362/267 |

* cited by examiner

*Primary Examiner*—Alan Cariaso
*Assistant Examiner*—James W Cranson, Jr.
(74) *Attorney, Agent, or Firm*—Stites & Harbison PLLC; Ross F. Hunt, Jr.

(57) ABSTRACT

A submersible light (10) comprising a lens (12) sealed to the front of the reflector (20), a replaceable light source (22) housed in an aperture (25) in the reflector, a pressure member (30) positioned behind the reflector to define an air chamber (32) open at the base of the light but in sealed communication with the aperture whereby, in use, as the light becomes submerged liquid enters the base of the pressure member to pressurise the air within the pressure member to in turn form a pocket of pressurised air in the space between the lens and the reflector and thus prevent entry of liquid into that space.

12 Claims, 1 Drawing Sheet

SUBMERSIBLE LIGHTING

FIELD OF THE INVENTION

Figure 1:
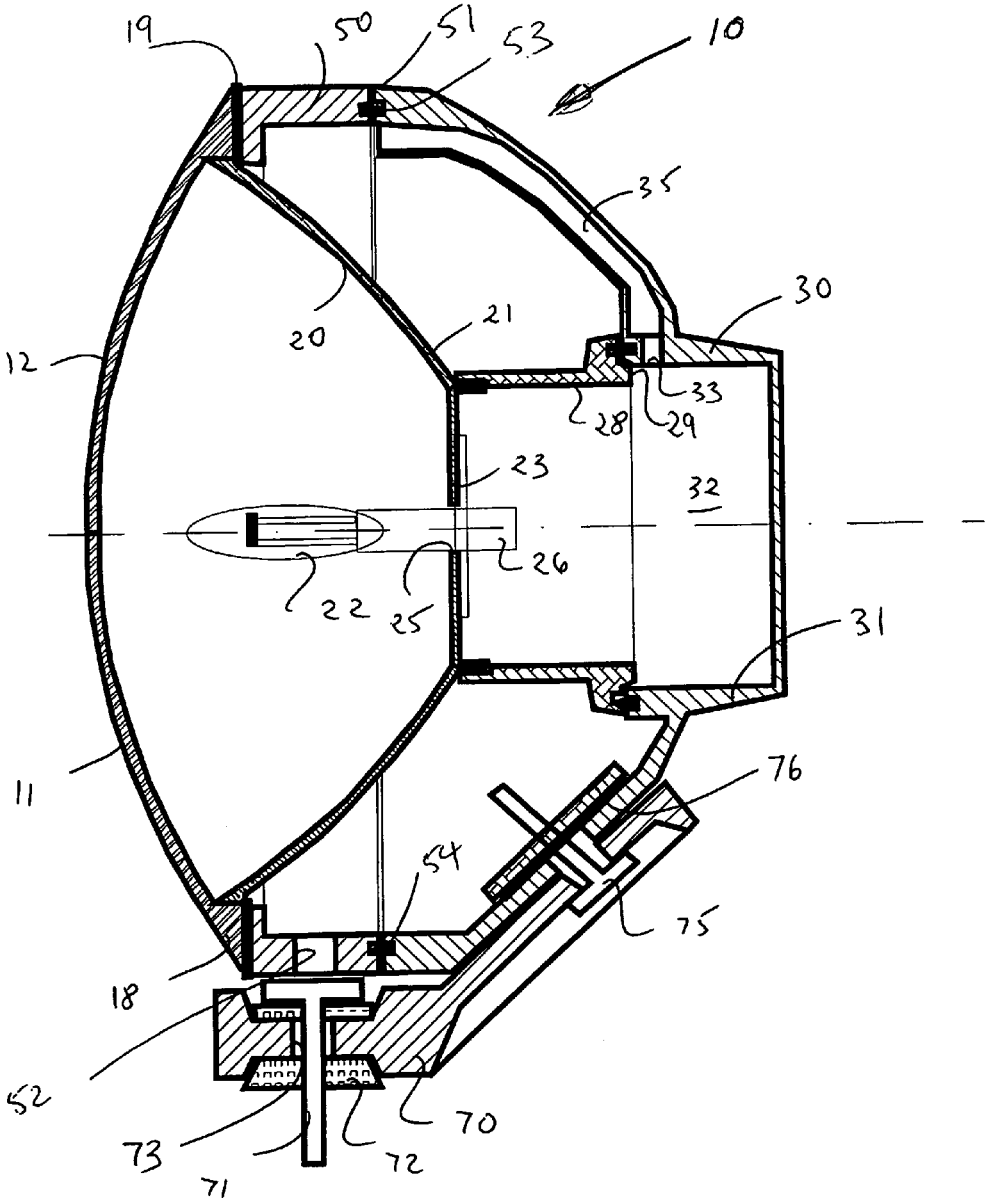

This invention relates to submersible lighting and in particular relates to submersible driving lights.

BACKGROUND OF THE INVENTION

Many off road vehicles are designed to make river and creek crossings. Often these vehicles include auxiliary driving lights that provide improved illumination of the passage of the vehicle. Many driving lights are Quartz Halogen or Xenon systems with replaceable bulbs. The fact that the bulbs are replaceable means that the space between the lens and reflector of the lights is not totally sealed. Thus, in situations where an off road vehicle passes through deep water, driving lights can be submerged in water. Once moisture enters the space between the reflector and the lens it is extremely difficult to remove. The efficiency of the light is consequently substantially impaired.

It is the solution of this problem that has brought about the present invention.

SUMMARY OF THE INVENTION

According to one aspect of the present invention there is provided a submersible light comprising a lens sealed to the front of a reflector, a replaceable light source housed in an aperture in the reflector, a pressure member positioned behind the reflector to define an air chamber open at the base of the light but in sealed communication with the aperture whereby, in use, as the light becomes submerged liquid enters the base of the pressure member to pressurise the air within the pressure member to in turn form a pocket of pressurised air in the space between the lens and the reflector and thus prevent entry of liquid into that space.

In a preferred embodiment the replaceable light source is a Quartz Halogen bulb that clips into a cylindrical housing that joins the aperture at the rear of the reflector.

DESCRIPTION OF THE INVENTION

An embodiment of the present invention will now be described by way of example only with reference to the accompanying drawing which is a cross-sectional view taken about a vertical line through the assembly.

DESCRIPTION OF THE PREFERRED EMBODIMENT

The vehicle driving light 10 shown in the accompanying drawing comprises the following major components: a glass lens 11 of circular cross-section presenting a convex surface 12 to the exterior, a parabolic reflector 20, a pressure housing 30 that sits behind the rear 21 of the reflector 20, and a mounting bracket 70 that facilitates support of the light.

The driving light 10 is arranged to be mounted to the vehicle via a support bolt 71 and threaded bracket that extends through an aperture 73 formed at a lower end of the mounting bracket 70.

The mounting bracket extends upwardly and rearwardly of the light to support the lower rear of the housing 30. The mounting bracket 70 is bolted to the rear of the housing via a nut 76 and bolt 75. The driving light 10 has a centrally positioned Quartz Halogen lightbulb 22 which is located in a support chamber 23 formed at the central rear of the reflector 20. The support chamber 23 communicates with the reflector through an aperture 25.

The rim of reflector 20 is permanently sealed to the interior of the rim 18 of the lens 11 through the use of a rubber or adhesive seal 19. The only opportunity for air or moisture to enter the space between the reflector 20 and the lens 11 is via the aperture 25 at the rear 21 of the reflector 20.

The reflector 20 is die-cast magnesium and defines a parabolic interior surface with a mirrored finish with the aperture 25 centrally at the base of the parabolic surface. The rear 21 of the reflector 20 includes a central cylindrical rearwardly projecting sleeve 28, the interior of which defines the chamber 23 into which a Quartz Halogen bulb mount 26 is supported. The bulb 22 extends through the aperture 25 in the reflector 20. The rear of the lens 11 and the reflector 20 is supported at the periphery by an annular support ring 50 which is bonded to the reflector 20 and lens 11. The support ring 50 has a rear face 51 which is secured by fasteners (not shown) to a periphery 53 of the pressure housing 30. An annular seal 54 is positioned between the abutting surface of the support ring 50 and housing 30.

The pressure housing 30 is dome shaped to sit behind the rear of the reflector 20. The dome terminates at a central projection 31 that is arranged to be a sealed fit on the rear face 29 of the sleeve 28. In this manner the interior 32 of the projection 31 is in sealed communication with the chamber 23. An aperture 33 in the side of the projection 31 communicates with a conduit 35 that extends up the top half of the interior of the housing 30 to terminate near the top of the light 10.

The wiring (not shown) that is coupled to the rear of the Quartz Halogen light element 22 is adapted to extend through the conduit 35 and into the interior of the housing 30 from which it will join the wiring loom of the vehicle via the bottom of the assembly. The rear of the support ring 50 has an air inlet aperture 52 which allows entry of air into what is otherwise a sealed chamber between the housing 30 and rear 21 of the reflector 20 and the chambers 23 and 32 which communicate with the space between the lens 11 and reflector 20. Thus the only opportunity for air or water to enter the space between the reflector 20 and the lens 11 comes through the aperture 52 at the centre of the reflector 20 via the chambers 23 and 32, the conduit 35 and the housing 30.

In the event that the vehicle enters deep water and the water rises up to the level of the driving light 10, the rising water enters the pressure housing 30 through the aperture 52 to pressurise the air that is in the sealed chambers of the assembly. This has the effect of pressurising the air that is between the reflector 20 and the lens 11 via the chambers 23, 32 and conduit 35. Thus, the pressurised air has no escape to form an air pocket between the lens and the reflector that prevents entry of water, notwithstanding the fact that the whole assembly might be submerged. In this arrangement the air pressure inside the light equals the water pressure outside allowing water only into the lower wet cavity of the housing 30 where it causes no harm and no pressure difference develops amongst the seals when the light is switched off or on under water, nor when the air between the lens and reflector is cooled by the water.

The housing 30 improves the aesthetic appearance of the assembly and also serves to reduce the likelihood of penetration of dust. In the preferred embodiment the components of the light other than the lens and bulb are made from aluminium. It is however understood that other materials such as plastics may be employed.

The driving light 10 described above has the advantage that it can be totally submerged in water without water entering the enclosure between the reflector and the lens. Thus, notwithstanding the fact that the light is not a totally sealed unit and that the light source can be readily replaced, it can be submersed without water entering the space between the reflector and the lens.

The invention is not restricted to auxiliary driving lights and can be deployed in many other types of submersible lights. It is envisaged that the invention is applicable to low voltage direct current lighting as well as mains voltage alternating current lighting. The lighting can be hand held lights for use in emergency situations such as in mines or drains. The invention is also applicable to any light that is used in an environment where there is a likelihood of the light being submerged in liquid.

The invention claimed is:

1. A submersible light comprising a lens sealed to the front of a reflector, a replaceable light source housed in an aperture in the reflector, a pressure member positioned behind the reflector to define an air chamber open at the base of the light and a sealed sub-chamber with the exterior of the aperture, a conduit connecting the sub-chamber to an upper part of the air chamber whereby, in use, as the light becomes submerged liquid enters the base of the pressure member to pressurize the air within the pressure member to in turn form a pocket of pressurized air in the space between the lens and the reflector and thus prevent entry of liquid into that space.

2. The submersible light according to claim 1 wherein the replaceable light source is coupled to wiring that is fed through the air chamber.

3. The submersible light according to claim 1 wherein the aperture is substantially central of the reflector.

4. The submersible light according to claim 1 wherein the pressure member is a dome shaped housing positioned to sit behind the reflector and over the exterior of the aperture.

5. The submersible light according to claim 4 wherein the housing has a periphery that is in sealed engagement with the rear of the reflector, the housing having an aperture in its base.

6. The submersible light according to claim 5 wherein a mounting bracket is bolted to the base of the pressure member, the mounting bracket being adapted to be secured to a vehicle to support the light.

7. The submersible light according to claim 1 wherein the replaceable light source is a bulb that clips into the aperture at the rear of the reflector.

8. The submersible light according to claim 4 wherein a rim is sealed to the rear of the periphery of the lens and the housing is sealed to the rim, an air aperture being positioned in the base of the rim.

9. The submersible light according to claim 8 wherein a sleeve is in sealed engagement with the rear of the reflector around the aperture, the sleeve being sealed to the pressure member and communicating with the top of the interior of the pressure member via a conduit.

10. A submersible light comprising a lens sealed to the front of a reflector, a replacement light source housed in an aperture in the reflector, a pressure member comprising a dome shaped housing is positioned behind the reflector to define an air chamber open at the base of the light and in sealed communication with the aperture whereby, in use, as the light becomes submerged liquid enters the base of the pressure member to pressurize the air within the pressure member to in turn form a pocket of pressurized air in the space between the lens and the reflector and thus prevent entry of liquid into that space.

11. The submersible light according to claim 10 wherein the pressure member defines a sealed sub-chamber with the exterior of the aperture, a conduit connecting the sub-chamber to an upper part of the air chamber.

12. The submersible light according to claim 10 wherein the housing has a periphery that is in sealed engagement with the rear of the reflector, the housing having an aperture in its base.

* * * * *